United States Patent [19]

Meyers et al.

[11] 4,164,171

[45] Aug. 14, 1979

[54] CARTON FORMING APPARATUS

[75] Inventors: George L. Meyers, Menasha; Thomas M. Gorshe, Neenah, both of Wis.

[73] Assignee: American Can Company, Greenwich, Conn.

[21] Appl. No.: 845,224

[22] Filed: Oct. 25, 1977

[51] Int. Cl.[2] ..... B31B 1/26

[52] U.S. Cl. ..... 93/49 R

[58] Field of Search ..... 93/12 R, 49 R, 49 AC, 93/82

[56] References Cited

U.S. PATENT DOCUMENTS

| | | | |
|---|---|---|---|
| 2,169,311 | 8/1939 | Widell | 93/49 R |
| 3,490,198 | 1/1970 | Beckman et al. | 93/49 AC |
| 3,656,417 | 4/1972 | Scully | 93/52 |
| 4,074,618 | 2/1978 | Gennari | 93/49 R |

*Primary Examiner*—Gerald A. Dost

*Attorney, Agent, or Firm*—Robert P. Auber; Ira S. Dorman; George P. Ziehmer

[57] ABSTRACT

Apparatus for conveying paperboard carton blanks through stations including means operative sequentially to fold the blanks about suitably scored lines into set-up tubular carton shells, including end closure flaps, about a mandrel extending along the line of blank travel, and means for rotationally transferring the set-up carton shells to carton filling and closing apparatus. Means is provided at a suitable one of the stations for applying adhesive to side flap portions of the folded blanks to retain their set-up modes as tubular carton shells.

7 Claims, 14 Drawing Figures

CARTON FORMING APPARATUS

BACKGROUND OF THE INVENTION

This invention relates to packaging, and more particularly to improvements in apparatus for forming tubular carton shells from single blanks of paperboard or the like.

In manufacturing operations involving the packaging of products in paperboard cartons it has been a practice for the packaging party either to purchase so-called pre-glued, flat-folded carton shells or to purchase carton-forming machinery of the type used by carton manufacturers. The carton purchasing procedure of course requires ordering, sorting, and setting-up of flat-folded carton shells in anticipation of the need for same, and the carton self-manufacturing procedure requires investment in carton forming apparatus. Requirements of this hereinabove described type represent, of course, cost factors in a highly competitive art.

It is a general objective of the present invention to provide improved carton shell forming apparatus that is economical both in its structure and in its operation.

It is another objective of the invention to provide improved carton shell forming apparatus that is readily adaptable for use in combination with carton filling apparatus of known type.

It is a further objective of the invention to provide improved carton shell forming apparatus that is versatile, both in its structure and in its adaptability for use in combination with other carton handling apparatus.

A still further objective of the invention is to provide improved transfer apparatus for carton shells or like articles operative to remove carton shells from a forming machine and to rotationally orient same for presentation to further shell handling apparatus, such as, for example, a carton filling machine.

SUMMARY OF THE INVENTION

In achievement of the foregoing as well as other objectives and advantages, the invention contemplates improved carton shell forming apparatus comprising: means for supplying a plurality of carton blanks; carton blank feed means for receiving blanks from said means for supplying and moving same in sequential steps along a predetermined path defined at least in part by fixedly mounted elongate mandrel means; means disposed along said path for forming a carton shell about said mandrel means; means for applying glue to a glue flap provided on said blank; means for folding said glue flap onto a confronting portion of said carton shell blank on said mandrel means to complete said shell; and means for removing said shell from said mandrel means.

The manner in which the foregoing as well as other objectives and advantages of the invention may best be achieved will be more fully understood from a consideration of the following description, taken in light of the accompanying drawing.

DESCRIPTION OF THE PREFERRED EMBODIMENT

Figures 1, 2, 3:
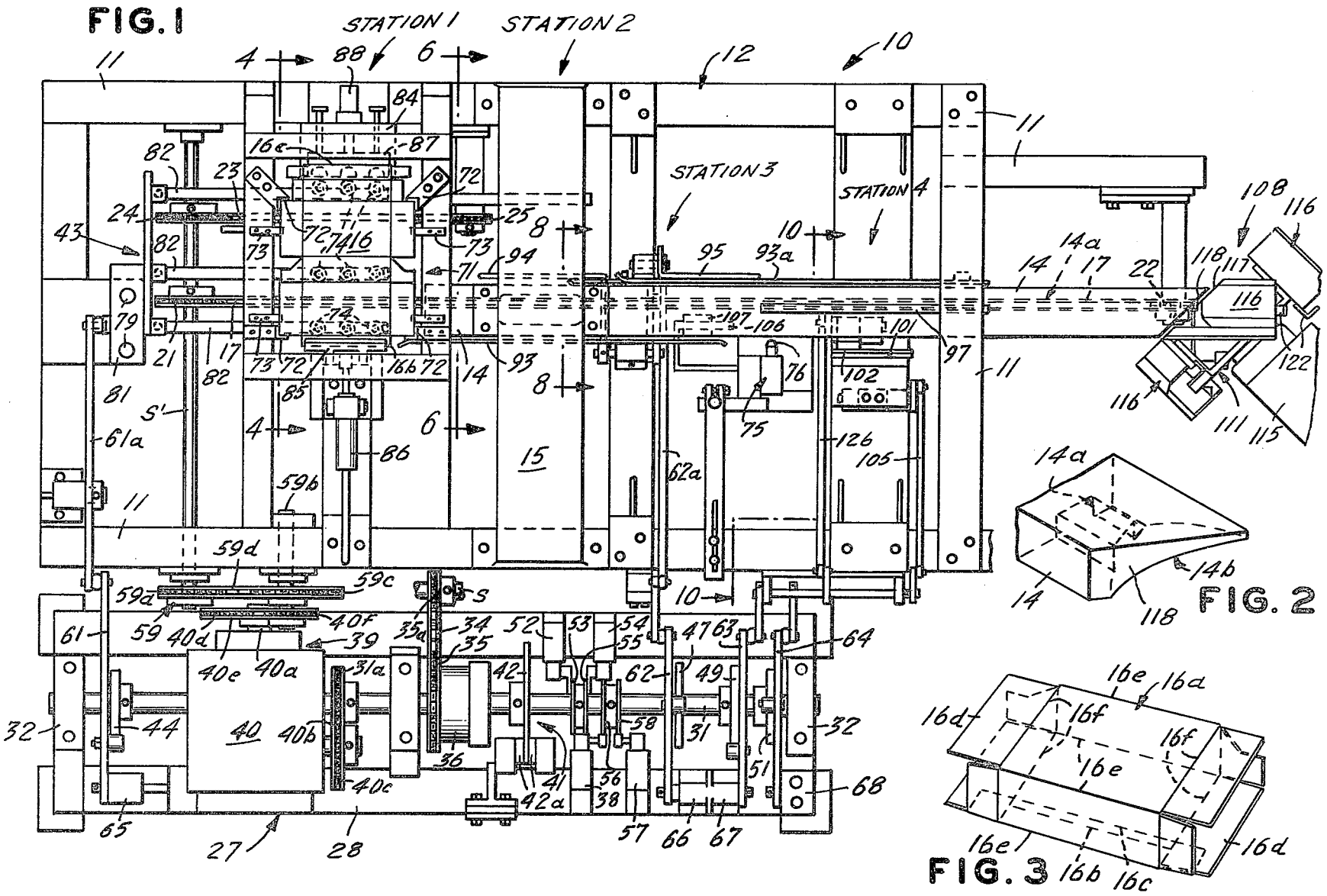
FIG. 1 is a top plan view of carton shell forming apparatus embodying the invention, and prior to initiating its operation.
FIG. 2 is a fragmentary perspective showing a right hand portion of the apparatus seen in FIG. 1.
FIG. 3 is a perspective view of one form of carton shell made by apparatus embodying the invention.

With more detailed reference to the drawing, and first to FIG. 1, carton shell forming apparatus 10 comprises frame structure 11 including a horizontally extending platform section 12. A carton shell forming mandrel 14 extends horizontally along platform section 12 and is fixedly supported on the latter by bracket means 15. As will be appreciated more fully from what follows, bracket means 15 is so constructed and arranged as to afford sufficient vertical clearance for a carton blank 16 as it is folded upwardly onto mandrel 14, as it is moved therealong, for subsequent sequential folding and gluing into a carton shell **16*a* as seen in FIG. 3, including side glue flaps 16*b*, 16*c*, and end closure flaps designated generally by the numeral 16*d*. The glue flaps are affixed to the carton panel portions, and panel portions to one another by longitudinally extending scored fold lines 16*e*. The closure flaps are attached to the panel portions by transversely extending scored fold lines 16*f***.

Figure 4:
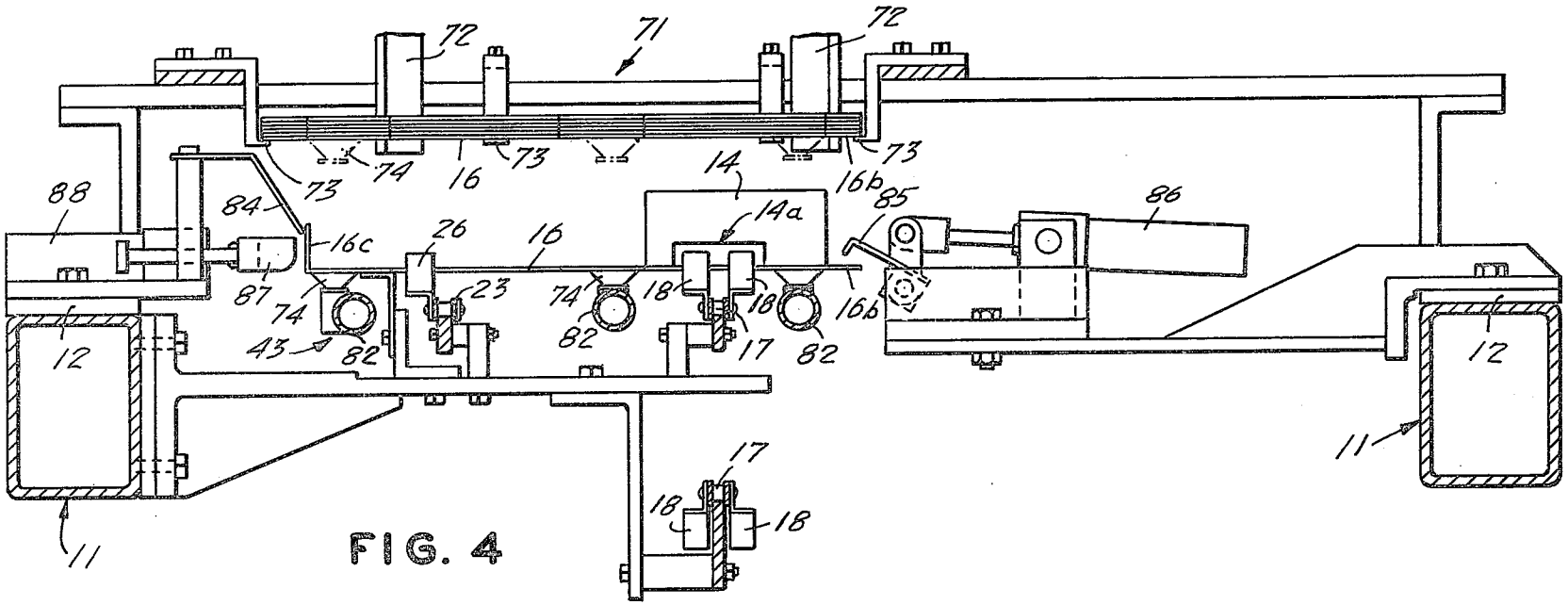
FIG. 4 is a fragmentary sectional view taken generally along line 4—4 applied to FIG. 1, looking in the direction of arrows applied thereto, and illustrating an operational feature of the shell forming apparatus.
Figure 5:
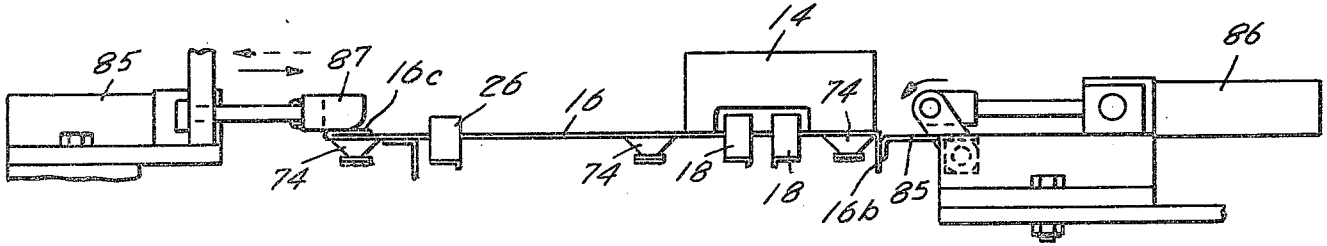
FIG. 5 is a partial view of apparatus seen in FIG. 4, illustrating a further operational feature.

A carton blank feed or conveyor apparatus for moving the blank along the mandrel includes an intermittently driven chain 17 extending lengthwise of platform section 12 beneath mandrel 14. Chain 17 is a standard roller chain supported on sprockets 21 and 22, and, as is seen to advantage in FIGS. 4 and 5, is provided with carton blank pusher lugs 18 so spaced along the chain as to be disposed at either end of a blank 16 as it is driven along the mandrel. Conveniently, lugs 18 are detachable and positionable at different locations along chain 17 to accomodate handling carton blanks of different lengths. Lugs 18 also are so dimensioned as to extend vertically into a groove **14*a* (see also FIGS. 2, 4, and 5) provided on the underside of mandrel 14 and extending the length thereof. Also, mandrel 14** is interchangeable with other sized mandrels for different sized blanks.

As is seen also in FIGS. 1 and 4, the conveyor apparatus further includes a shorter chain 23 disposed about sprockets 24 and 25 on platform 12, so that it is parallel with chain 17, and is provided with lugs 26 that cooperate with lugs 18 to maintain blank 16 square to the mandrel 14 as it is moved therealong in earlier stages of its folding sequence. In the operation of chains 17 and 23, and as will be more fully described in what follows, sprockets 21 and 24 serve as the respective drive sprockets and sprockets 22 and 25 serve as the respective idler sprockets. It will be also noted that sprocket 22 is located at the "downstream" end of mandrel 14, and sprocket 25 is located in the region of the "upstream" end of the mandrel. Thus, the conveyor chains 17 and 23 are coextensive, in mutually spaced relation for feeding the flattened blank 16 to the mandrel, and chain 17 and lugs 18 thereafter conveys the blank along the mandrel. Thus, the coextensive sections of chains 17 and 23 form a first conveyor section, whereas the extended portion of chain 17 forms a second conveyor section.

Still with reference to FIG. 1, a drive assembly designated generally by the numeral 27 comprises a frame portion 28 disposed laterally of, and at a lower level than, platform section 12 of frame structure 11. A camshaft 31 is rotationally supported in pillow blocks 32 provided on frame portion 28 and prime mover means (not shown) is drivingly coupled with camshaft 31 through a roller chain 34 disposed about a sprocket 35*a* on a shaft S of the prime mover means and a sprocket 35 on a clutch 36 coupled to the camshaft. Clutch 36 is of the air-operated, single position type affording on-off drive of camshaft 31 according to operation of the prime mover which conveniently may be the drive means for a carton filling machine (not shown) with which the carton shell forming apparatus 10 is associated. An indexing drive assembly 39 is operative to convert the continuous rotary motion of camshaft 31 to an intermittent rotary drive for conveyor chains 17 and 23.

Indexing drive assembly 39 includes an indexing box 40 of commercially available type, being a four stop, 90° output rotation box with a 120° index time and a 240° dwell time on the timing of its output shaft 40*a*. Indexing box 40 is driven by a roller chain 40*b* that extends over camshaft sprocket 31*a* and box input shaft sprocket 40*c*. Sprockets 31*a* and 40*c* are of identical diameters, affording a one-to-one drive ratio.

Conveyor chain drive sprockets 21 and 24 are keyed to and driven by a common shaft S' through an overload clutch 59 coupled with this shaft and directly driven by a sprocket 59*a*. Overload clutch 59 is so constructed and arranged as both to disconnect shaft S' from sprocket 59*a* and to operate suitable switch means (not shown) for shutting down the apparatus in the event of its malfunction. Sprocket 59*a* is driven through a pair of motion increaser drives in order to achieve a large increment of travel of chain lugs 18 and 26 for each 90° increment of movement of indexing-box output shaft 40*a*. The pair of motion increaser drives is used in lieu of a single larger motion increaser drive advantageously to afford lower inertia and lesser chain wrap-up. For example, sprocket 40*d* affords a six-inch travel of chain 40*e* for each 90° indexing rotation of shaft 40*a*. Chain 40*e* extends over both sprocket 40*d* and a sprocket 40*f* on countershaft 59*b*. Sprocket 40*f* is one-half the diameter of sprocket 40*d*, so that it rotates 180° for each 90° of indexing drive by shaft 40*a*. Also mounted on countershaft 59*b*, is a sprocket 59*c* which also rotates 180° per 90° rotation of indexing shaft 40*a*. Sprocket 59*c* on countershaft 59*b* is twice the diameter of sprocket 59*a* so that it affords a twelve-inch travel of chain 59*d* extending thereover, per indexing by box 40 of overload clutch 59.

By way of example, a carton filling machine usually is set to operate at a slightly faster rate than the product conveyor (not shown) with which it is associated. This relationship ensures that there is no product accumulation on the product conveyor. Occasionally, however, the carton filling machine will "starve" the product conveyor and, under such a condition, the carton shell forming apparatus 10 will have to "wait" for the product conveyor to load up. In order to "wait", clutch 36 will be operated to disengage, thereafter to engage when the product conveyer loads up to a predetermined amount. In the operation of clutch 36, clutch-in (engage) and clutch-out (disengage) signals are generated by limit switches (not shown) on the product conveyor. Single position clutch 36 is operated by an air circuit (not shown) under the control of an electric solenoid valve 38, and ensures proper synchronization between the carton filling apparatus and carton shell forming apparatus 10. A brake 41 includes a disc 42 on camshaft 31 engageable by friction pads 42*a* to halt rotation of camshaft 31 immediately upon disengagement of clutch 36.

Further to the invention, camshaft 31 carries a plurality of cams to be more fully described in what follows, and serving to operate corresponding linkages for mechanisms disposed along frame platform 12 and arranged to perform sequential folding steps on the carton shell blanks as they pause in their sequential movement along mandrel 14. Cams also to be described are provided for the operation of limit switches for various control functions. The several carton shell forming and folding stations and their related mechanisms, including operating cams, levers and limit switches are identified as follows:

Station 1—Carton Blank Drawdown Mechanism 43—Cam 44; Carton Blank Drawdown Vacuum Solenoid Valve Switch 52—Cam 53; and Carton Blank Prebreak Air Cyl. Sol. Valve 54—Cam 55.

Station 2—Carton Initial Folding Mechanism—Cam 47

Station 3—Carton Secondary Folding Mechanism—Cam 47

Station 4—Carton Final Folding Mechanism—Cams 49 and 51

Other switches and their corresponding operating cams are identified as follows:

Clutch and Brake Air Solenoid Valve Switch 38—Cam 56; and

Glue Gun Air Solenoid Valve Switch 57—Cam 58.

Each of cams 44, 47, 49, and 51 is disposed and adapted to operate lever arms 61, 62, 63, and 64 pivotal on respective bearing means 65, 66, 67, and 68 mounted on frame portion 28. Arms 61 to 64 are suitably spring-loaded to maintain engagement of their followers with their respective cams.

Still with reference to FIGS. 1 and 4, a carton magazine assembly 71 is disposed above drawdown mechanism 43 of Station 1, and includes four vertically extending carton blank guides 72 within the confines of which horizontally extending, suitably scored and flattened carton blanks 16 are stacked in vertical array. Guides 72 are supported on an upper portion of frame 11, together with interposed carton blank support fingers 73 set at such a height as to present the lowermost blank 16 for engagement by vacuum cups 74 provided on drawdown mechanism 43.

Starting with feed of a carton blank 16, the blank drawdown mechanism 43 is caused to move upwardly by suitable linkage 61*a* coupled with lever arm 61 operated by cam 44 as its shaft 31 is driven. Drawdown mechanism 43 includes a pair of vertically extending guide rods 79 (FIG. 1) on which a bushing block assembly 81 is slidable. Block 81 supports three horizontally extending vacuum bar units 82 provided with upwardly presented vacuum cups 74 spaced therealong. Drawdown mechanism 43 at its upper limit of travel causes vacuum cups 74 to engage the lowermost one of the carton blanks 16 in magazine assembly 71. Cam 53 then operates drawdown vacuum switch 52 to introduce a vacuum in cups 74, following which cam 44 operates to lower the mechanism 43, and draw a blank 16 downwardly into position in which it lies between a pair of suitably presented lugs 26 on conveyor chain 23 and a pair of similarly presented lugs 18 and chain 17 (FIGS. 4 and 5). Upon engagement of blank 16 by the chain lugs 18, 26, cam 53 operates switch 52 to break the vacuum in cups 74. This location to which blank 16 is initially fed subjects it to a prebreak mechanism comprising a breaker bar 84, a pivotal flap plow 85 operative by an air cylinder 86, and a slidable flap plow 87 operative by an air cylinder 88. Air cylinder 86 is supplied pressurized air by suitable air-valve tripping means (not shown) on the carton blank drawdown mechanism 43, and air cylinder 88 is supplied pressurized air by a solenoid valve 54 operative by cam 55.

Figure 6:
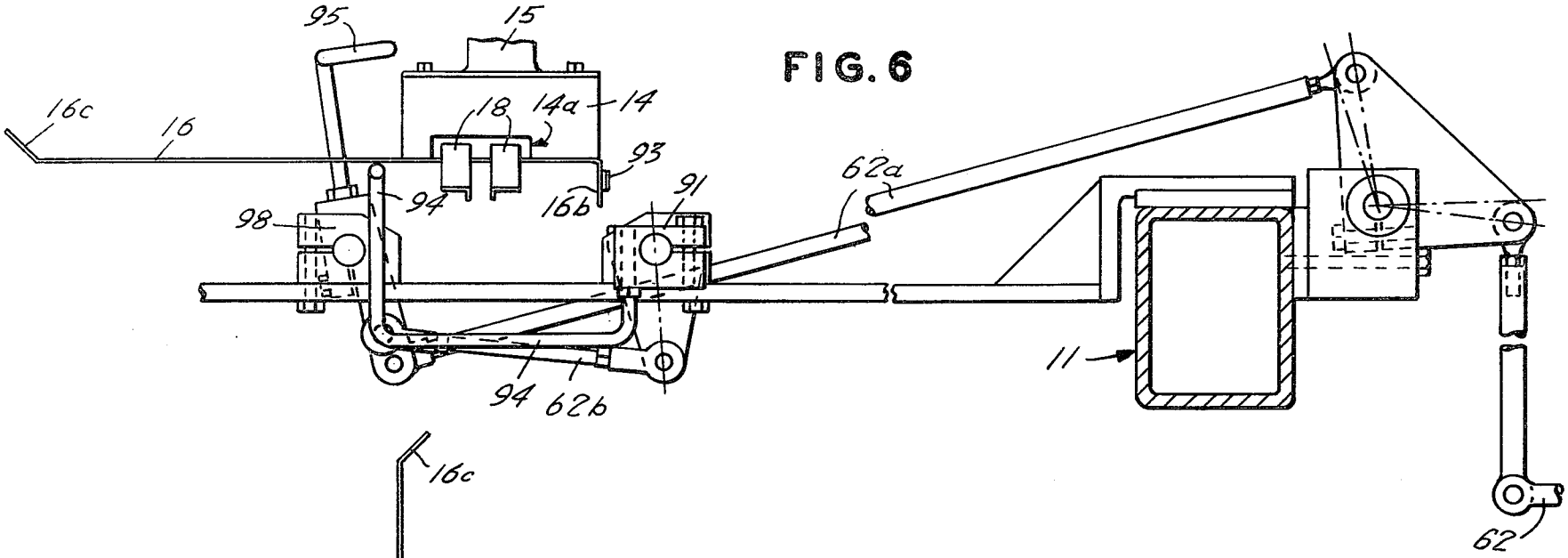
FIG. 6 is a fragmentary sectional view taken generally along line 6—6 applied to FIG. 1, looking in the direction of arrows applied thereto, and illustrating a further operational feature of the apparatus.
Figure 7:
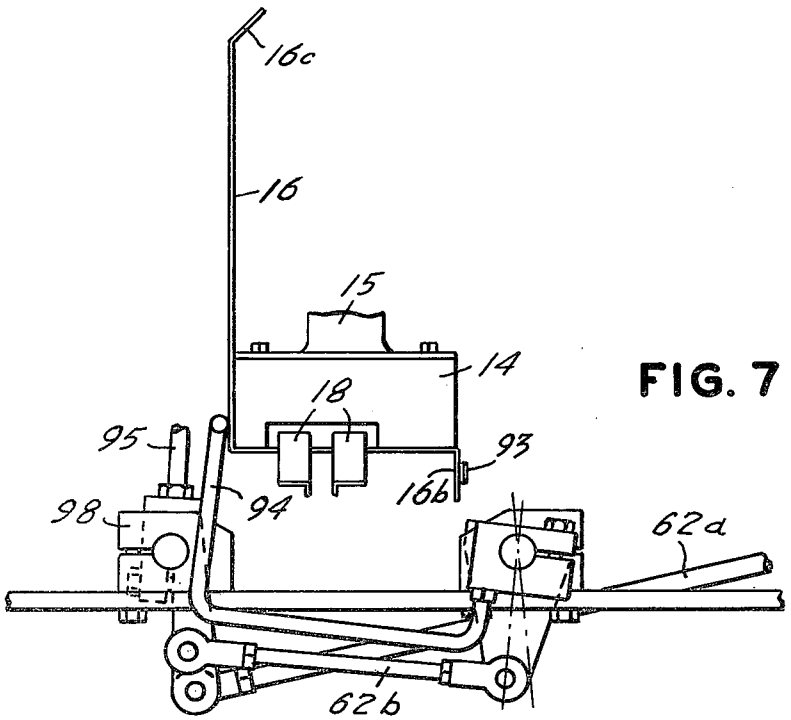
FIG. 7 is a partial view of apparatus seen in FIG. 6, and illustrating a further operational feature thereof.

Thus as carton blank 16 is fed to and seated in the described, conveyor-held position at Station 1, and as is illustrated in FIG. 4, breaker bar 84 will fold carton flap 16*c* upwardly about another scored fold line 16*e* through an angle of 90° following which flap plow 87 operates according to the solid directional arrow to fold flap 16*c* through an additional 90° (FIG. 5), about its scored fold line onto the surface of the blank. Also at Station 1, flap plow 85 is operated according to the curved directional arrow (FIG. 5), to fold carton flap 16*b* downwardly about its scored fold line 16*e*, through an angle of 90°. Flap plow 87 is then retracted (broken line arrow) and the vacuum on cups 74 is broken, releasing blank 16 for indexing movement to Station 2 (FIG. 6) by lugs 18 and 26 on chains 17 and 23, in the course of which movement the blank is moved beneath the supported, "upstream" end portion of mandrel 14 where the flap 16*b* is engaged by fixed flap plow 93 to hold it in its folded position and the first, or lowermost panel portion held against the mandrel by suitable plow means (not shown). Suitably presented folding mechanism includes a folding arm 94 pivotable upwardly on bearing 91 (FIG. 7) to fold a second panel portion carton blank 16 about another of scored fold lines 16*e* against the side of mandrel 14. Arm 94 is movable by cam 47 through suitable cam follower 62 and linkage means 62*a*, 62*b*, on bearing 91.

Figure 8:
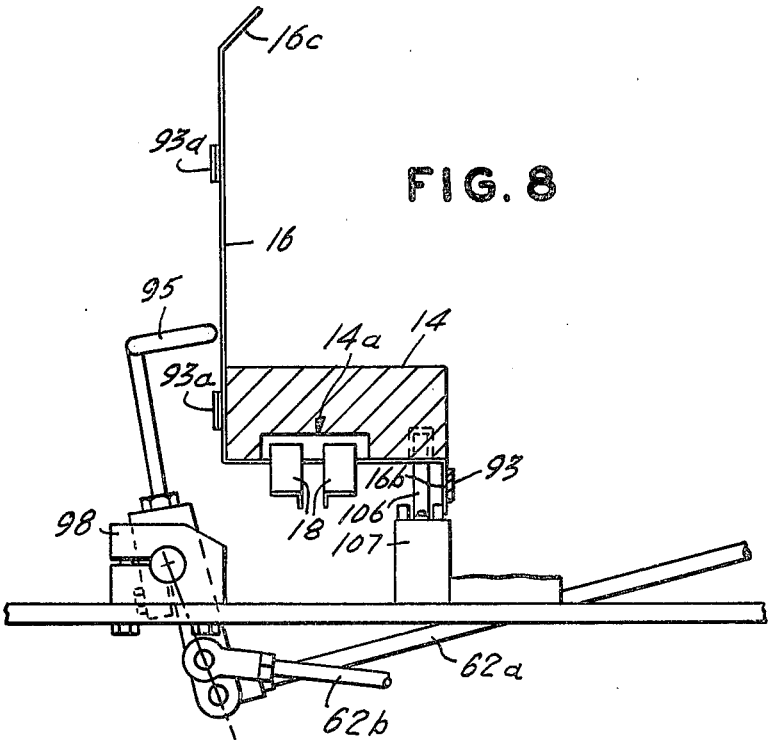
FIGS. 8 and 9 are fragmentary sectional views taken generally along line 8—8 applied to FIG. 1, and illustrating a still further operational feature of the apparatus.
Figure 9:
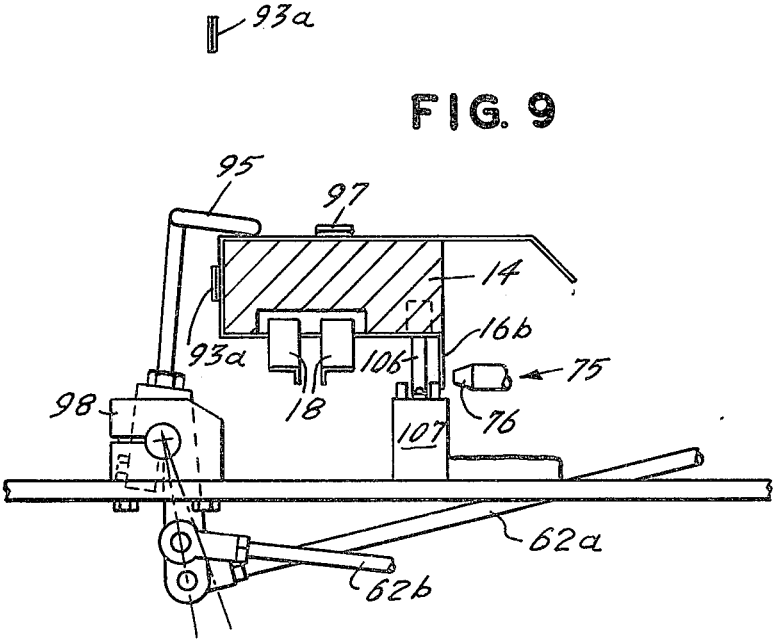

While the folding arm 94 is held in its upper position, the folded carton blank 16 is indexed by movement of chain 17 and its lug 18 to Station 3 (FIG. 8) for presentation to folding arm 95 pivotable on bearing 98. In moving to Station 3, the folded second panel portion moves under flap plow 93*a* where it is held for subsequent folding operations on other panel portions. The arm 94 is then dropped to its lowered, or retracted position. Folding arm 95 is operative by cam 47 through cam follower 62 and linkage means 62*a* to pivot upwardly and fold the third panel portion of the carton blank onto the top of mandrel 14 about another of scored fold lines 16*a* (FIG. 9). Also as a carton blank is moved into position at Station 3, the carton blank sensing arm 106 of a switch 107 is actuated by engagement with the blank. Switch 107 is wired in series electrical circuit with glue gun solenoid valve 75, so that glue gun 76 will be actuated only if there is a carton blank 16 fed from Station 2 to Station 3.

Figure 12:
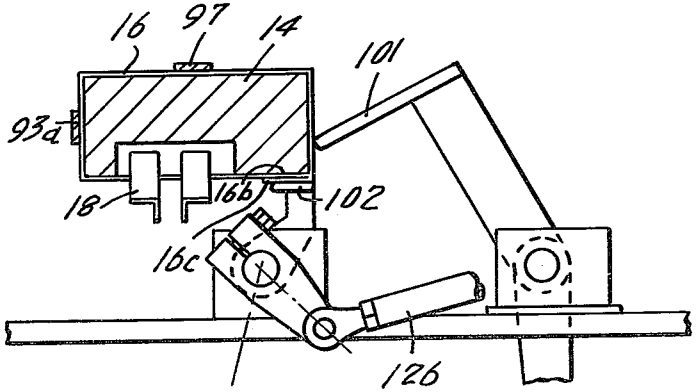
FIGS. 11 and 12 are partial views of apparatus seen in FIG. 10, and illustrating further operational features of the apparatus.

The carton blank 16 is then indexed by chain 17 and lug 18 to Station 4 (FIGS. 10 to 12) for presentation to the final folding mechanism, in the course of which indexing a suitably positioned glue applicator mechanism 75 (FIGS. 1 and 9) operates to apply a line of glue to carton flap 16*b*. It will of course be understood that the term "glue" is intended to denote adhesives, generally, of known types suitable for use in the assembly of folded cartons. Glue applicator 75 is of conventional design, and is disposed along the line of carton blank travel, between the secondary folding mechanism of Station 3 and final folding mechanism of Station 4. Assembly 75 includes an air operated glue gun 76 including a solenoid actuatable air valve controlled by switch 57 through switch actuating cam 58. Also in moving to Station 4, the third panel portion of the carton blank 16 folded onto the top of mandrel 14 (FIG. 10) slides under a suitably presented flap plow 97 which holds the carton blank down against the top of the mandrel, following which the folding arm 95 of the preceding mechanism (FIG. 7) is moved to its retracted position.

The final folding mechanism includes a pair of flap folders 101 and 102 that are sequentially operative by cams 49 and 51 through suitably connected cam followers 63 and 64 and their linkage means 105 and 126 respectively. Flap folder 101 is operative initially to fold the upper illustrated fourth panel portion down onto the mandrel (FIG. 11) about its corresponding scored fold line 16*e*. Flap folder 102 is operative to fold and press the outer carton glue flap portion 16*c* against the glue line on the carton flap on the first panel portion 16*b*, and then finally to fold both flap 16*b* and flap portion 16*c* against the larger region of the first panel portion. The result of this final fold is a glued carton shell disposed about the mandrel.

Figure 10:
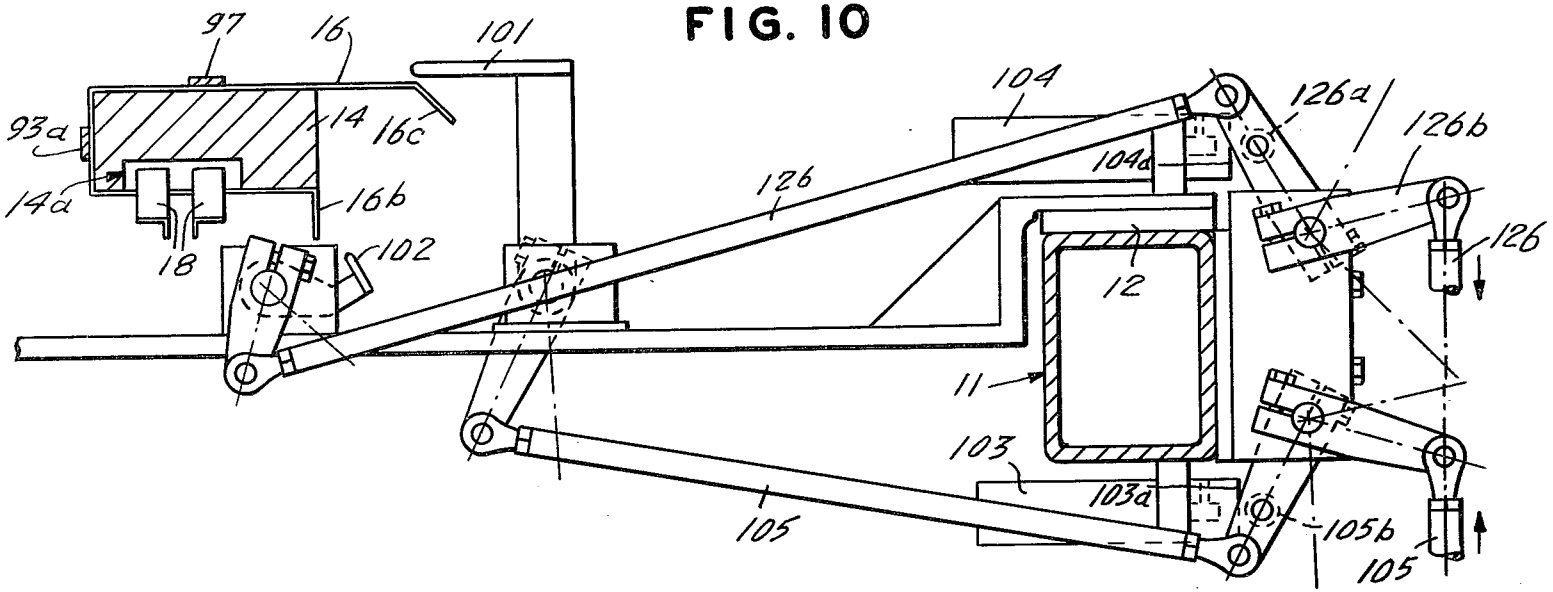
FIG. 10 is a fragmentary sectional view taken generally along lines 10—10 applied to FIG. 1, and illustrating another operational feature of the apparatus.
Figure 11:
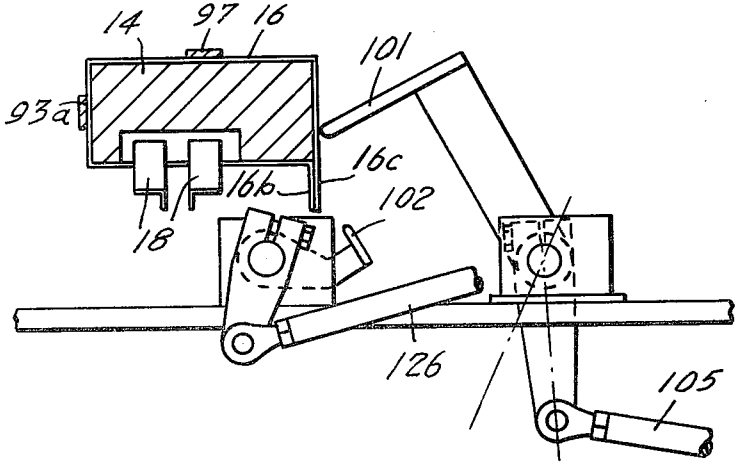

There is provided at Station 4 (FIG. 10) an air override system for the flap folders 101 and 102, and operative in the event of a malfunction such as, for example, jamming of the overall machine or of a machine associated therewith. An override system is important because prolonged machine stoppage results in solidification of the glue on the carton flap, and subsequent start-up of the machine produces an unglued carton due to the premature solidification of the glue. As is seen in FIG. 10, the override system includes air cylinders 103, 104, operative mechanically to override cam actuation of linkages 105, 126, respectively, coupled with flap folders 101 and 102, in response to operation of suitable sensing means, such as, for example, an air solenoid that is triggered by stopping the machine. Override is achieved through abutting engagement of pistons 103*a*, 104*a*, of air cylinders 103, 104 with pins 105*a* and 126*a* on bell cranks 105*b* and 126*b* of the respective cam-actuated linkages. Upon restarting the machine, the override pistons 103*a*, 104*a* are retracted. From Station 4, the carton shell 16 is indexed by chain 17 and lug 18, to the "downstream" end portion of mandrel 14, which portion is reduced in size (not shown) to facilitate sliding removal of the carton shells from the machine.

Figure 13:
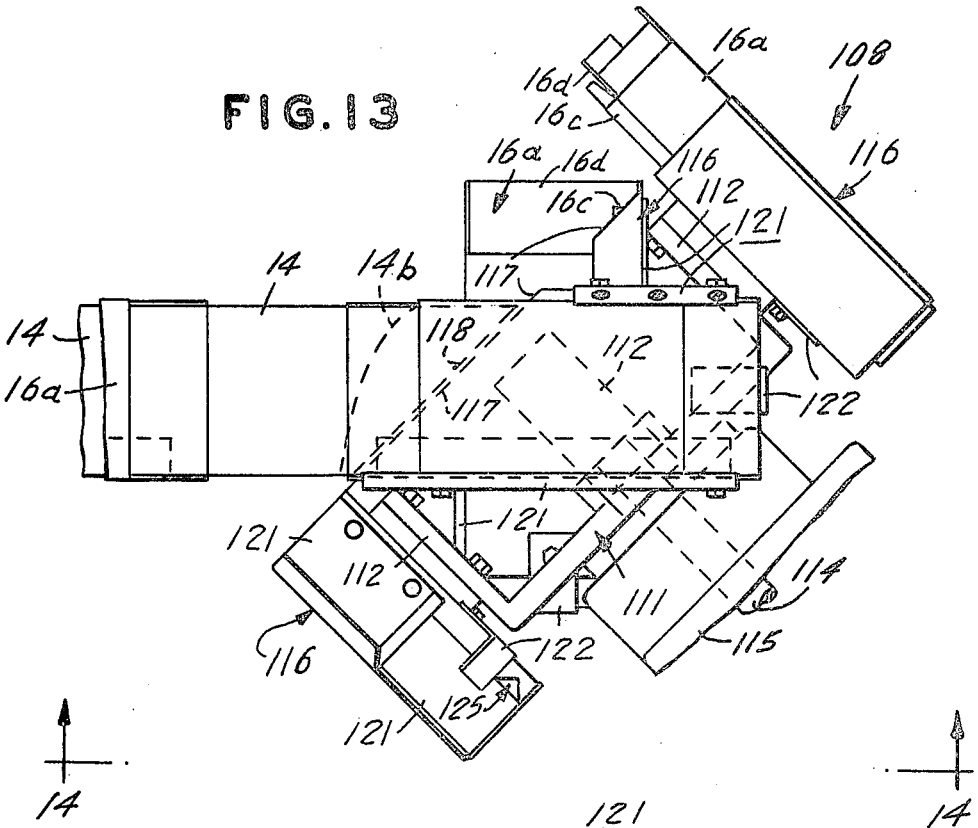
FIG. 13 is an enlarged fragmentary view of the right-hand portion of the apparatus shown in FIG. 1.
Figure 14:
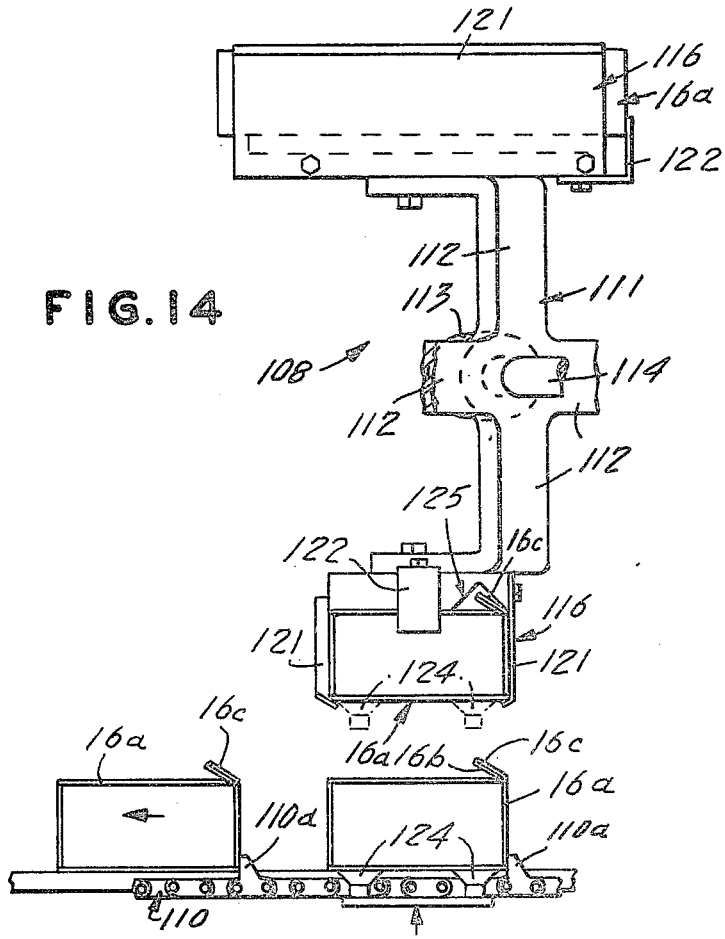
FIG. 14 is a elevational view of apparatus shown in FIG. 13, as seen looking in the direction of arrows 14—14 applied thereto.

With reference again to FIG. 1, and also to FIGS. 13 and 14, transfer means for receiving and transporting open ended shells 16*a* as they are discharged from the downstream end portion of mandrel 14, to suitable conveyor means, is designated generally by the numeral 108. Conveyor means for transporting carton shells 16*a* to a suitable filling machine (not shown) is designated generally by the numeral 110 (FIG. 14). By way of example, conveyor means 110 may take the form of a double chain provided with lugs 110*a*, disposed below, and extending generally parallel to mandrel 14.

The means 108 for transferring carton shells 16*a* from mandrel 14 to conveyor 110 comprises wheel means 111 provided with four arms or spokes 112 of equal length, spaced 90° apart, and rotatable on a hub 113 affixed to the shaft 114 of a conventional indexing apparatus 115 mounted on suitable frame structure. Shaft 114 is so positioned that its axis is below and extends with angularity, for example at an angle of 45°, as respects the line of extension of mandrel 14.

The end of each arm 112 supports a carton shell receiving pocket or carrier 117 disposed in alignment with the line of extent of mandrel 14, so that each pocket extends at an angle of 45° as respects the rotational plane of wheel means 111 about its axis as defined by shaft 114. Thus the sum of the aforesaid shaft and pocket angles is 90°, or the angle through which the carton shell is turned about its transverse axis upon rotation of wheel means 111 through an angle of 180° to transfer a carton shell 16*a* from mandrel 14 to conveyor 110. Indexing apparatus 115 is operable to rotate wheel means 111 through an angle of 90° per indexing increment, affording a suitable dwell period for positioning a pocket 116 in alignment with mandrel 14 in order to receive a carton shell 16*a*.

Each pocket 116 is of generally U-shaped cross-section and its interior surface is slightly larger than the outer surface of a carton shell 16*a* to accommodate ease of sliding of the carton shell into and out of the pocket. Each sidewall pocket 116 also is angled along its extremity toward the one opposite, in order to aid in retention of a shell.

The end of mandrel 14 is formed at a 45° angle as seen at 118 in FIGS. 1, 2, and 13, and is disposed for matching alignment with the end pocket 116 formed also at a 45° angle, as seen at 117 in FIGS. 1 and 13. The opposite end of pocket 116 is provided with an abutment 122 disposed and adapted to engage and establish the position of a shell 16*a* in the pocket. A V-shaped groove 125 extends the length of the bottom of pocket 116 and receives the slightly projecting flaps 16*b*, 16*c* of the formed shell. A curved surface 14*b* is provided on the underside of the end portion of mandrel 14 to ensure clearance of the end flaps 16*d* therewith as a carton shell is rotationally withdrawn from the mandrel by transfer wheel 108.

In operation of the transfer means 108, and with reference to FIGS. 1, 2, and 13 in which wheel means 111 is in an indexed position, a carton shell is moved from mandrel 14 into pocket 116. The wheel means is then moved incrementally to its next indexed position to present a pocket 116 and carton shell 16*a* for alignment with lugs 110*a* on conveyor 110. In moving from mandrel 14 to wheel means 111, a carton is turned, simultaneously, through an angle of 90° about its transverse axis and through an angle of 180° about its longitudinal axis.

A pair of suction cups 124 are disposed and adapted for extension to a carton shell engaging position in the lower, oriented position thereof, and retraction to a carton shell removing position, whereupon a removed carton shell 16*a* is drawn down onto conveyor means 110 associated with the carton filling apparatus (not shown) and operative to move the transferred carton shells in the direction of the applied arrow.

While the disclosed carton shell 16*a* formed by apparatus embodying the invention is for a carton of the so-called flip-top type, it will be appreciated that other carton shells can be fabricated for other cartons such as, for example, cartons of the end-opening type. The presently disclosed carton shell is, of course, typical of a kind not readily adapted for flattening after or during the gluing process. Accordingly, it will be appreciated that the capability of producing set-up carton shells is an important advantage of the invention.

While the inventon has been described with reference to a preferred embodiment, it will be apparent to those skilled in the art that various changes and modifications can be made without departing from the scope of the appended claims.

We claim:

1. Apparatus for forming carton blanks into tubular carton shells each having at least one shell sealing flap on a lateral portion thereof, comprising;

means defining serially disposed stations through which said carton blanks sequentially may be moved;

incrementally driven conveyor means for moving said carton blanks through said stations with a pause at each said station;

means defining a mandrel extending along the path of movement of said conveyor means, and on which said carton blanks are formed into carton shells;

means for sequentially forming shells on said mandrel as said carton blanks are moved by said conveyor means;

carton blank feeding means for delivering individual carton blanks to said conveyor means upon incremental drive thereof;

said conveyor means comprising first and second sections extending in substantially parallel, mutually spaced relation in the direction of the recited path of travel, said first section extending between said blank feeding means and the upstream end of said mandrel, said second section extending between said blank feeding means and the downstream end of said mandrel;

and means disposed along the path of travel of said conveyor means for adhering said sealing flaps to seal said carton shells.

2. Apparatus according to claim 1, and characterized in that:

said mandrel comprises a main body portion supported at its upstream end and including a longitudinal groove;

and said conveyor means comprises drive lugs disposed and operative drivingly to engage individual carton blanks and move the latter along said mandrel, said lugs further being disposed to extend into said longitudinal groove for travel therein.

3. Apparatus according to claim 1, and characterized further in that said first section of said conveyor means comprises a pair of parallely extending, mutually spaced chain means, and said second section comprises an extended portion of one of said chain means.

4. Apparatus according to claim 1, and further including sensor means disposed adjacent said mandrel and operatively engaged by a carton blank upon movement thereof by said incrementally driven conveyor means to maintain operation of the latter, the lack of operative engagement of said sensor means, due to absence of a carton blank upon an incremental movement of said conveyor means, being effective to prevent operation of said means for adhering said sealing flaps.

5. Apparatus according to claim 4, and characterized in that said means for adhering includes an applicator operative to apply adhesive individually to a recited carton sealing flap, the recited absence of a carton blank being effective to prevent operation of said applicator.

6. Apparatus according to claim 1, and further including means for transferring said carton shells from said conveyor means, upon incremental movements thereof, to a predetermined location in rotated position as respects both the longitudinal and the transverse axes of said shells, said means for transferring comprising:

a plurality of mutually spaced shell carriers mounted for rotational movement about an axis disposed between said conveyor means and said predetermined location and at first angle as respects the direction of travel of said conveyor, said carriers being disposed at a second angle as respects the rotational plane of movement thereof about said axis;

and means for effecting incremental movements of said means for transferring said shells, in correspondence with incremental movements of said conveyor means, to accommodate feed of said shells formed on said conveyor means into said carriers for transfer to said predetermined location, thereby to turn said shells simultaneously about their recited longitudinal and transverse axes as respects said conveyor means.

7. Apparatus according to claim 1, and characterized in that said serially disposed stations comprise:

a first, carton blank feeding and folding station operative to present to said conveyor means a carton blank having first, second, third, and fourth panel portions, and a glue flap portion, each said portion being disposed sequentially adjacent the other in the order of recitation, and including linkage means operative to prefold at least said glue flap portion and said second panel portion;

a second, carton blank folding station at which said first panel portion is disposed against a surface portion of said mandrel by said conveyor means, and including linkage means operative to fold said second, adjacent panel portion against a second surface portion of said mandrel;

a third, carton blank folding station including means operative to hold said first and said second panel portions against said mandrel, and linkage means operative to fold a third adjacent panel portion against a third surface portion of said mandrel; and a fourth, carton blank folding station including means operative to hold said third panel portion against said mandrel, linkage means operative sequentially to fold a fourth adjacent panel portion against a fourth surface portion of said mandrel and an adjacent glue flap portion against said first panel portion for glue attachment thereto, thereby to complete said carton shell, and further including means operative automatically to effect said glue attachment upon shut-down of the recited drive of said conveyor means.

* * * * *